US005711076A

United States Patent [19]

Yin et al.

[11] Patent Number: 5,711,076

[45] Date of Patent: Jan. 27, 1998

[54] SHAVING SYSTEM WITH IMPROVED GUARD STRUCTURE

[75] Inventors: Yuling Yin, Quincy; Alfred Porcaro, Everett; Mingchih Michael Tseng, Hingham; Philip John Sweeney, Taunton, all of Mass.

[73] Assignee: The Gillette Company, Boston, Mass.

[21] Appl. No.: 624,819

[22] Filed: Mar. 27, 1996

[51] Int. Cl.[6] ..... B26B 21/44

[52] U.S. Cl. ..... 30/41; 30/34.2

[58] Field of Search ..... 30/41, 538, 537, 30/50, 34.2, 34.05, 81, 77

[56] References Cited

U.S. PATENT DOCUMENTS

| | | | |
|---|---|---|---|
| 4,170,821 | 10/1979 | Booth . | |
| 4,586,255 | 5/1986 | Jacobson . | |
| 4,624,051 | 11/1986 | Apprille, Jr., et al. . | |
| 4,683,096 | 7/1987 | Ferraro . | |
| 4,692,986 | 9/1987 | Mota et al. . | |
| 4,697,342 | 10/1987 | Ferraro . | |
| 4,778,640 | 10/1988 | Braun et al. . | |
| 4,850,106 | 7/1989 | Braun et al. . | |
| 4,872,263 | 10/1989 | Etheredge, III . | |
| 4,875,287 | 10/1989 | Creasy et al. . | |
| 5,005,287 | 4/1991 | Ritter . | |
| 5,056,221 | 10/1991 | Thoene . | |
| 5,056,222 | 10/1991 | Miller et al. . | |
| 5,063,667 | 11/1991 | Jacobson . | |
| 5,067,238 | 11/1991 | Miller et al. | 30/41 |
| 5,079,839 | 1/1992 | Conrad, Jr., et al. . | |
| 5,095,619 | 3/1992 | Davis et al. . | |
| 5,095,620 | 3/1992 | Althaus . | |
| 5,113,585 | 5/1992 | Rogers et al. . | |
| 5,134,775 | 8/1992 | Althaus et al. . | |
| 5,161,307 | 11/1992 | Althaus . | |
| 5,191,712 | 3/1993 | Crook et al. . | |
| 5,249,361 | 10/1993 | Apprille, Jr., et al. . | |
| 5,345,680 | 9/1994 | Vreeland et al. . | |
| 5,347,716 | 9/1994 | Crook . | |
| 5,349,750 | 9/1994 | Tseng . | |
| 5,369,885 | 12/1994 | Ferraro | 30/41 |
| 5,410,810 | 5/1995 | Gillibrand . | |
| 5,416,973 | 5/1995 | Brown et al. . | |
| 5,430,939 | 7/1995 | Johnston . | |
| 5,454,164 | 10/1995 | Yin et al. . | |

FOREIGN PATENT DOCUMENTS

| | | |
|---|---|---|
| 0 348 627 | 1/1990 | European Pat. Off. . |
| 0 287 387 B1 | 9/1991 | European Pat. Off. . |
| 0 313 184 B1 | 6/1992 | European Pat. Off. . |
| 2 024 082 | 1/1980 | United Kingdom . |
| 2 183 523 | 6/1987 | United Kingdom . |
| WO 92/15278 | 9/1992 | WIPO . |
| WO 93/16135 | 8/1993 | WIPO . |
| WO 94/04325 | 3/1994 | WIPO . |

*Primary Examiner*—Douglas D. Watts

*Attorney, Agent, or Firm*—Fish & Richardson P.C.

[57] ABSTRACT

A shaving system that includes a housing, one or more blades mounted on the housing, a cap behind the blades on the housing, and a guard structure in front of the blades on the housing, the guard structure including flexible skin-engaging protrusions that engage a user's skin in front of the blades and a water leachable shaving aid composite positioned to deliver a shaving aid to the skin behind the flexible skin-engaging protrusions.

26 Claims, 2 Drawing Sheets

SHAVING SYSTEM WITH IMPROVED GUARD STRUCTURE

BACKGROUND OF THE INVENTION

The invention relates to a shaving system with an improved guard structure.

In replaceable shaving cartridges and disposable razors, one or more blades are secured in a plastic housing. The surface in front of the blade or blades is known as the guard, and the surface behind the blade or blades is known as the cap.

The guard is often provided with a structure designed to engage and stretch the skin in front of the blades, and the cap is generally designed to slide over the skin and in some cases is provided with a water leachable lubricating strip. Published PCT application WO 96/01171, which is hereby incorporated by reference, reviews the disclosure of various forms of guard, cap, and blades in various blade assemblies described in prior art patents. For example, Apprille et al. U.S. Pat. No. 5,249,361 discloses a two-part molded guard structure having an upper skin engaging portion of elastomeric material with a plurality of upwardly projecting protrusions formed thereon and a lower base portion of rigid plastic material that is anchored in the cartridge housing.

Other guard structures are shown in Crook et al. U.S. Pat. No. 5,191,712. Miller et al. U.S. Pat. No. 5,056,222 describes shaving cartridges with spring-biased metal housing members that are located in front of the blades, contain water leachable materials that are exposed between metal webs, and have skin tensioning structures at different locations on the metal housing member.

SUMMARY OF THE INVENTION

The invention features, in general, a shaving system that includes a housing, one or more blades mounted on the housing, a cap behind the blades on the housing, and a guard structure in front of the blades on the housing. The guard structure includes flexible skin-engaging protrusions that engage a user's skin in front of the blades and a water leachable shaving aid composite positioned to deliver a shaving aid to the skin behind the flexible skin-engaging protrusions. The shaving aid is thus desirably delivered in front of the blades without interfering with the ability of the flexible skin-engaging protrusions to engage the user's skin.

In preferred embodiments, the guard structure includes a backstop member that defines a blade exposure for the first blade. The flexible skin-engaging protrusions are in the form of flexible fins that extend generally parallel to the blades. The water leachable shaving aid composite has a skin-contacting surface that extends uninterrupted for substantially the length of the blades, and the fins extend above the skin-contacting surface. The water leachable shaving aid composite includes a water-insoluble polymer and a water-soluble polymer that provides the shaving aid. Preferably the shaving aid is a skin lubricant; other additives can be provided as desired.

The guard structure preferably includes a rigid base that is anchored in the housing, and the flexible skin-engaging protrusions (preferably fins) are mounted on the rigid base. The water leachable shaving aid composite can also be mounted on the rigid base. The backstop member can be mounted on the rigid base, can be formed on the same component as the rigid base or the housing, or can be formed of the same material as the flexible material component or as part of the flexible material component. The rigid base, the flexible material component and the backstop member can be molded together, coextruded together, or formed separately and adhered together. The water leachable shaving aid composite can be secured to the rigid base, the flexible material component or the housing by adhesive or mechanical interlock. Also, the guard structure can be made by three-color molding or three-color extrusion.

Alternatively, the water leachable shaving aid can be contained within a cavity in the guard structure, and the guard structure can have channels extending from the shaving aid to a location behind flexible skin-engaging protrusions. Other protrusions, e.g., fin segments oriented at different angles with respect to said blades or nubs, can also be used.

Preferably the flexible material component is made of elastomeric material such as a rubber (e.g., natural rubber, butyl rubber, nitrile rubber, styrene butadiene rubber) or a thermoplastic elastomer (TPE) (e.g., styrene butadiene styrene (SBS) TPE, styrene ethylene butadiene styrene (SEBS) TPE, polyester TPE, polyamide TPE, polyurethane TPE, polyolefin based TPE, and blends of any of these TPEs). Preferably the rigid base is made of a thermoplastic material, e.g., polystyrene, high-impact polystyrene, polypropylene, acrylonitrile butadiene styrene, polycarbonate, Noryl, or Nylosn.

Preferably the blades are spring-biased, and the cartridge is pivotally mounted with respect to a handle.

Embodiments of the invention may achieve one or more of the following advantages. Additional amounts of shaving aid can be provided to the skin. In addition, it is believed that the embodiments of the invention will provide reduced nicks, improved closeness, and improved lubrication, and may also have improved comfort. Also, when a razor is placed face down on a wet counter, there may be less tendency for the guard structure to stick on the counter surface.

Other advantages and features of the invention will be apparent from the following description of preferred embodiments thereof and from the claims.

DESCRIPTION OF THE PREFERRED EMBODIMENTS

Figure 1:
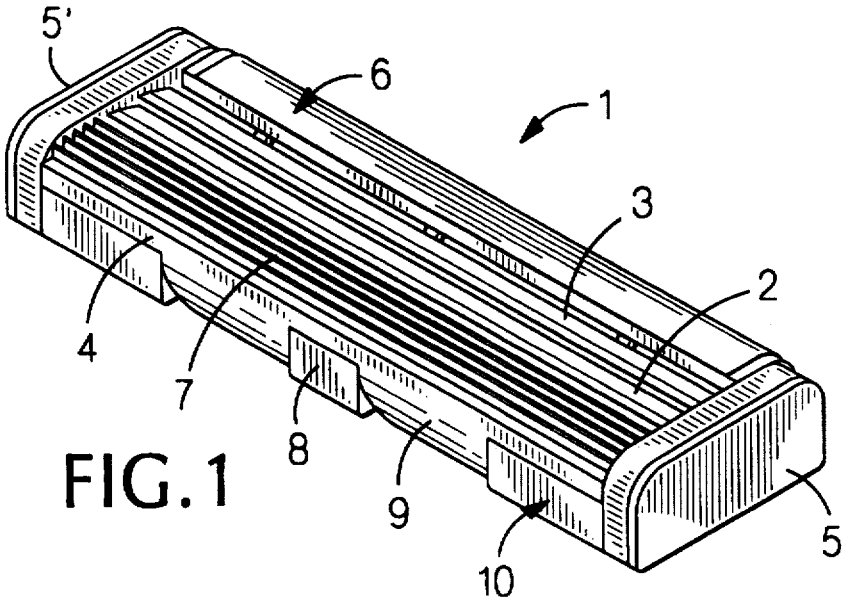
FIG. 1 is a perspective view of a shaving system incorporating an improved guard structure according to the invention.

Referring to FIG. 1, there is shown an elongated razor cartridge 1. Commercial razor blade cartridges of this type are common in the marketplace. Cartridge 10 includes one or more spring-biased blades 2, 3 and a rigid plastic housing 10 comprised of a lower base member 8 and two end units 5 and 5'. Base member 8 has arcuate surfaces that provide, with other structure on base 9, a shell bearing pivotal connection to a handle (not shown).

Blades are supported on springs or other movable members which allow the blade edges to conform to the contours of the face. Guard structure 4 is in front of first blade 2, and cap 6 is behind the second blade 3. Cap 6 preferably is a shaving aid composite including a water-insoluble polymer matrix (high impact polystyrene) and a water-soluble shaving aid (polyethylene oxide), which leaches out of the composite during shaving to enhance shave comfort.

Figure 2:
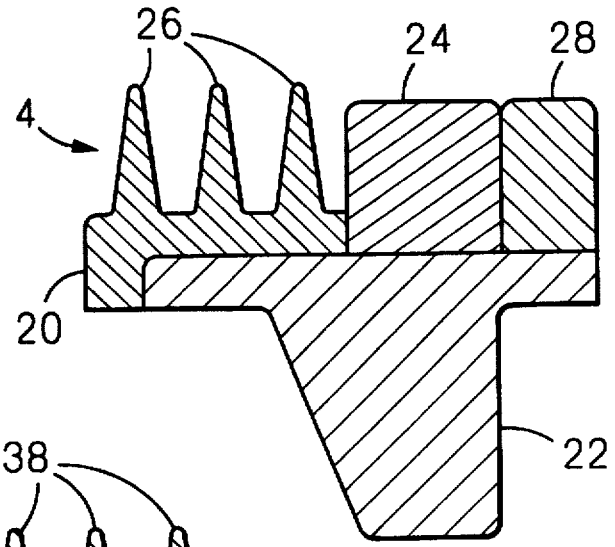
FIG. 2 is a diagrammatic, vertical sectional view of a guard structure of the FIG. 1 shaving system.

Referring to FIG. 2, there is shown guard structure 4 which includes component 20 made of flexible material, rigid base 22 made of a rigid plastic, water leachable shaving aid composite 24 mounted on rigid base 22, and backstop member 28 mounted on rigid base 22. Component 20 has three parallel flexible fins 26 at its front that extend above the upper surface of shaving aid composite 36 to engage the shaver's skin. Backstop member 28 provides a fixed reference in order to define the desired exposure for front blade 2. Backstop member 28 can be made of the same material as component 20 or can be made of the same material as rigid base 20 and be formed integrally with it.

Water leachable shaving aid composite 24 is located between fins 26 and backstop member 28 and is secured to rigid base 22 by adhesive. Components 20 and 28 are formed by injection molding onto rigid base member 22. Rigid base member 22 anchors guard structure 4 to base member 8 of the housing, and for example, can include an interlocking structure as described in U.S. Pat. No. 5,249,361, which is hereby incorporated by reference.

Figure 3:
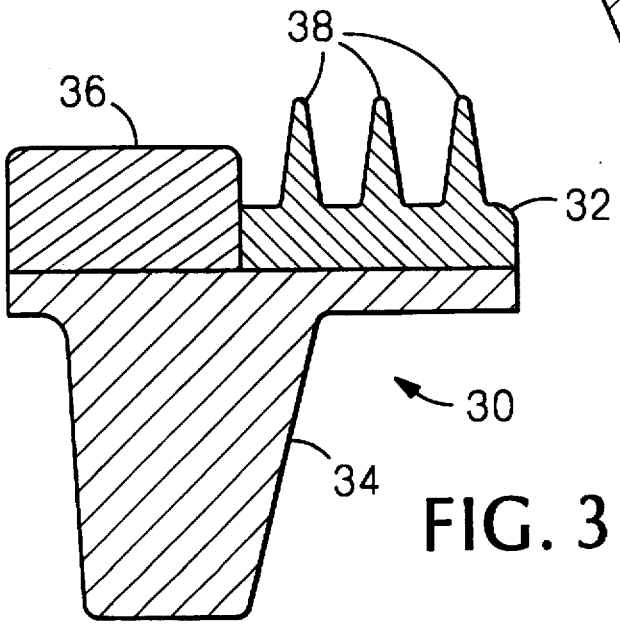
FIGS. 3, 4, and 5 are diagrammatic, vertical sectional views of alternative embodiments of guard structures for the FIG. 1 shaving system.

Referring to FIG. 3, an alternative guard structure 30 is shown. It includes flexible fin component 32 mounted on the front of rigid base 34 and water leachable shaving aid composite 36 mounted on the rear portion of rigid base 34. Composite 36 is secured by adhesive to rigid base 34, and fin component 32 is secured to rigid base 34 by molding on it. Flexible fin component 32 has three fins 38 which extend above the upper surface of shaving aid composite 36.

Figure 4:
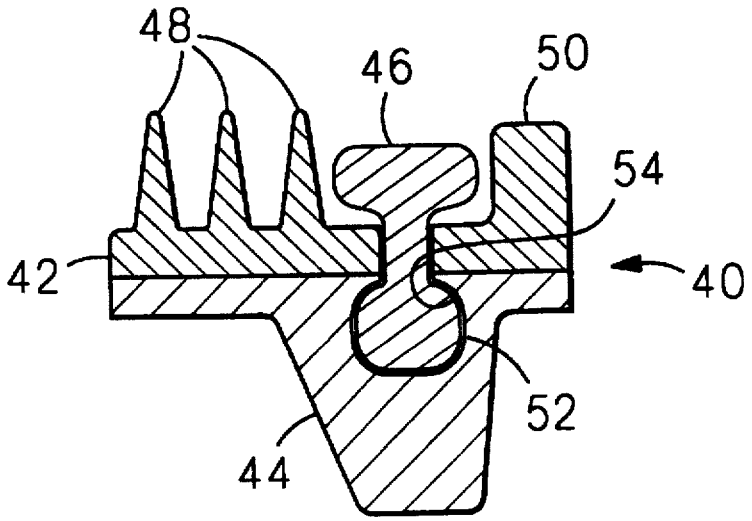

Referring to FIG. 4, there is shown guard structure 40 including flexible component 42, rigid base 44, water leachable shaving aid composite 46, and backstop member 50. Flexible component 42 includes three flexible fins 48 at its front. Backstop member 50 defines the exposure for first blade 2. Water leachable shaving composite 46 includes 5 enlarged bottom portion 52 that is anchored in recess 54 in rigid base 44. Recess 54 has a narrow opening which causes enlarged bottom portion 52.to be secured in recess 54 by mechanical interlock. Backstop member 50 can be made of the same material as component 42 or can be made of the same material as rigid base 44 and be formed integrally with it.

Figure 5:
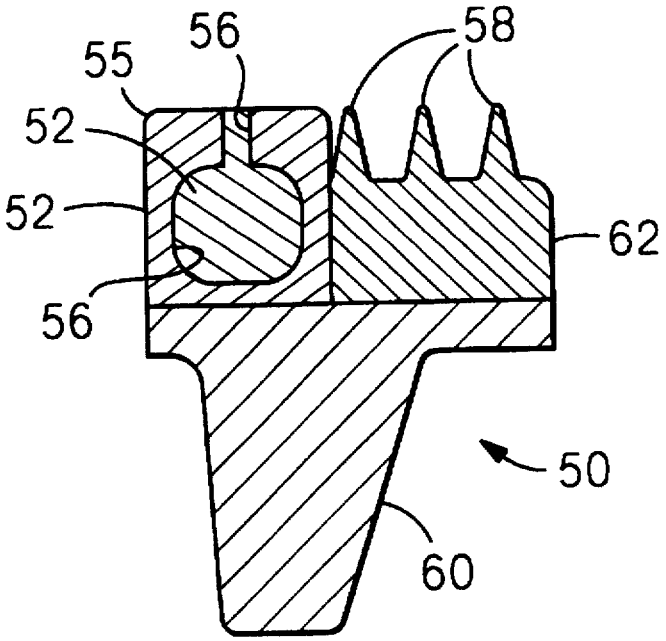

Referring to FIG. 5, in guard structure 50, the water leachable shaving aid composite 52 is contained within cavity 54 in backstop member 55, and channels 56 extend from the shaving aid composite to a location behind flexible skin-engaging fins 58. U.S. Ser. No. 08/497,194, filed Jun. 30, 1995, which is hereby incorporated by reference, describes cavity and channel configurations and materials that can be used. Structure 50 also includes rigid base member 60 and flexible material component 62, which includes the fins. Backstop member 55 can be made of the same material as component 62 or can be made of the same material as rigid base 60 and be formed integrally with it.

The elastomeric protrusions (here fins) can have different sizes and shapes, including those defined in U.S. Pat. No. 5,191,712, which is hereby incorporated by reference. In particular the protrusions can be in the form of nubs or fin segments oriented at different angles with respect to the blades, e.g., in herring bone or checker board patterns. The protrusions can also take the form of spaced fin segments that are arranged in rows oriented parallel to the blades or spaced fin segments that are arranged both parallel to and perpendicular to the blades.

Rigid bases 22, 34, 44, 60 are preferably made of thermoplastic materials, e.g., polystyrene, high-impact polystyrene, polypropylene, polyethylene, acrylonitrile butadiene styrene (ABS), polycarbonate, polyurethane, Nylon, 5 and Noryl. Flexible components 20, 32, 42 are preferably made from thermoplastic elastomers (TPEs) or rubbers; examples include natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend.

Shaving aid composites 24, 36, 46, 52 preferably comprise a matrix of a water-insoluble polymer and, dispersed within the matrix, a skin lubricating water-soluble polymer. Alternatively, the shaving aid composite may comprise a sheath of water-insoluble polymer (e.g., the cavity defining component in FIG. 5) that surrounds a core which includes a skin-lubricating water-soluble polymer.

Suitable water-insoluble polymers which can be used for the matrix (or sheath) include polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, most preferably a high impact polystyrene (i.e., Polystyrene-butadiene), such as Mobil 4324 (Mobil Corporation).

Suitable skin lubricating water-soluble polymers include polyethylene oxide, polyvinyl pyrrolidone, polyacrylamide, hydroxypropyl cellulose, polyvinyl imidazoline, and polyhydroxyethylmethacrylate. The more preferred water-soluble polymers are the polyethylene oxides generally known as POLYOX (available from Union Carbide Corporation) or ALKOX (available from Meisei Chemical Works, Kyota, Japan). These polyethylene oxides will preferably have molecular weights of about 100,000 to 6 million, most preferably about 300,000 to 5 million. The most preferred polyethylene oxide comprises a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also advantageously contain up to about 10% by weight of a low molecular weight (i.e., MW<10,000) polyethylene glycol such as PEG-100.

The shaving aid composite may also optionally include an inclusion complex of a skin-soothing agent with a cylcodextrin, low molecular weight water-soluble release enhancing agents Such as polyethylene glycol (e.g., 1–10% by weight), water-swellable release enhancing agents such as cross-linked polyacrylics (e.g., 2–7% by weight), colorants, antioxidants, preservatives, microbicidal agents, beard softeners, astringents, depilatories, medicinal agents, conditioning agents, cooling agents, etc.

Particular preferred embodiments include rigid bases of polypropylene, flexible components of an SEBS based TPE available under the Kraton G trade designation or C-Flex trade designation, and a shaving aid composite of about 35% high impact polystyrene, about 55% polyethylene oxide, and about 10% polyethylene glycol.

The guard structure can be manufactured by two-color injection molding. The polypropylene rigid base is molded first at about 200°–230° C. mold temperature, and the SEBS based TPE fin component is then molded on the polypropylene rigid base at around 200°–230° C. mold temperature. Shaving aid composites are made by extruding the polyethylene oxide (PEO) blend using an Haake HBI system 90 at typical processing conditions.

Alternatively, the three components (or two of the three components) can be made by coextrusion or can be made separately and then adhered together with adhesive.

In use, flexible fins 26, 38, 48, 58 engage the user's skin first, tending to stretch the skin and pull on the shaving stubble. The flexible fins may dig into the skin, drawing hair out from the pore, and may repeatedly grab and release the stubble, holding the hair at a lower point with each contact. The flexible fins may additionally act as a squeegee, removing excess fluid on the face, and may also provide pleasant tactile sensations.

Shaving aid composites 24, 36, 46, 52 apply a lubricant to the stretched skin and stubble prior to cutting by the blades. Shaving aid composites 24, 36, 46 may change shape and wear away with repeated use. With the embodiments described in FIGS. 2, 4, and 5 backstop members 28, 50 provide a permanent surface to define the exposure for the first blade regardless of the change in shape of the shaving aid composite 24 or 46 that may occur with repeated use.

It is believed that the shaving systems with the improved guard structure as described will have reduced nicks, improved closeness, and improved lubrication, and may also have improved comfort. Also, when a razor is placed face down on a wet counter, there may be less tendency for the guard structure to stick on the counter surface. The extra fill flow material permits additional fill flow material to be used.

Features and advantages of the invention are further illustrated by the following example of a guard structure, but the particular materials and amounts thereof as well as other conditions and details, should not be construed to limit this invention.

EXAMPLE

A guard structure has made of a rigid support of polypropylene (Amoco propylene 7635), flexible fins and a backstop of SEBS (GLS Elastalloy 6545), and a shaving aid composite of the following PEO blend:

Polyethylene oxide (Union Carbide Polyox N750): 22%

Polyethylene oxide (Union Carbide Polyox Coagulant): 33%

High impact polystyrene (Mobil HIPS 4324) 33%

Polyethylene glycol (Dow PEG 4500): 10%

Other additives: 2%

A two color injection molding machine was used to make the rigid support, the flexible fins and flexible backstop. The polypropylene part was molded first, and the fins and flexible backstop were then molded on the polypropylene support. The molding temperature for polypropylene was around 200°–230° C., and the molding temperature for SEBS was around 200°–220° C. The PEO blend was extruded to the necessary profile using a Haake HBI System 90 extruder at around 180°–200° C. The extruded PEO blend was then cut to length, and then the shaving aid composite pieces were glued to the molded parts.

Other embodiments of the invention are within the scope of the claims.

What is claimed is:

1. A shaving system comprising a housing, one or more blades mounted on said housing, a cap behind said blades on said housing, and a guard structure in front of said blades on said housing, said guard structure including a plurality of flexible skin-engaging protrusions to engage a user's skin in front of said blades and a water leachable shaving aid composite positioned to deliver a shaving aid to said skin behind said flexible skin-engaging protrusions and in front of said one or more blades.

2. The shaving system of claim 1 wherein said one or more blades include a first blade immediately behind said guard structure, and said guard structure further comprises a backstop member that defines a blade exposure for said first blade.

3. The shaving system of claim 1 wherein said flexible skin-engaging protrusions comprise flexible fins extending generally parallel to said blades.

4. The shaving system of claim 1 wherein said water leachable shaving aid composite has a skin-contacting surface that extends uninterrupted for substantially the length of said one or more blades.

5. The shaving system of claim 4 wherein said one or more blades include a first blade immediately behind said guard structure, and wherein said guard structure further comprises a backstop member that defines a blade exposure for the first blade on said housing.

6. The shaving system of claim 1 wherein said water leachable shaving aid composite comprises a water-insoluble polymer and a water-soluble polymer that provides said shaving aid.

7. The shaving system of claim 6 wherein said shaving aid is a skin lubricant.

8. The shaving system of claim i wherein said guard structure includes a rigid base that is anchored in said housing, and said flexible skin-engaging protrusions are on a flexible material component mounted on said rigid base.

9. The shaving system of claim 8 wherein said water leachable shaving aid composite is mounted on said rigid base and has a skin-contacting surface that extends uninterrupted for substantially the length of said one or more blades and is located behind said flexible skin engaging protrusions.

10. The shaving system of claim 9 wherein said one or more blades include a first blade immediately behind said guard structure, and wherein said guard structure further comprises a backstop member that defines a blade exposure for the first blade on said housing.

11. The shaving system of claim 8 wherein said flexible skin-engaging protrusions are on a flexible material component that has the same section extending for substantially the length of said one or more blades, and said rigid base and said flexible material component are coextruded.

12. The shaving system of claim 8 wherein said flexible skin-engaging protrusions are on a flexible material component that is molded with said rigid base.

13. The shaving system of claim 8 wherein said flexible skin-engaging protrusions are on a flexible material component that is adhesively secured to said rigid base.

14. The shaving system of claim 8 wherein said water leachable shaving aid composite is secured to said rigid base by adhesive.

15. The shaving system of claim 8 wherein said water leachable shaving aid composite is secured by a mechanical interlock.

16. The shaving system of claim 1 wherein said water leachable shaving aid is contained within a cavity in said guard structure, and said guard structure has channels extending from said shaving aid to a location behind said flexible skin-engaging protrusions.

17. The Shaving system of claim 4 wherein said flexible skin-engaging protrusions extend above said water leachable shaving aid composite.

18. The shaving system of claim 17 wherein said flexible skin-engaging protrusions comprise flexible fins extending generally parallel to said one or more blades.

19. The shaving system of claim 3 wherein said fins are provided in fin segments oriented at different angles with respect to said blades.

20. The shaving system of claim 1 wherein said flexible skin-engaging protrusions are made of elastomeric material.

21. The shaving system of claim 8 wherein said rigid base is made of a thermoplastic material.

22. The shaving system of claim 21 wherein said thermoplastic material is a member of the group consisting of polystyrene, high-impact polystyrene, polypropylene, acrylonitrile butadiene styrene, polycarbonate, Noryl, Nylosn.

23. The shaving system of claim 8 wherein said flexible material component is made of thermoplastic elastomer.

24. The shaving system of claim 1 wherein said one or more blades are spring-biased.

25. The shaving system of claim 1 wherein said housing includes structure for providing a pivotal mounting with respect to a handle.

26. The shaving system of claim 3 wherein said flexible skin engaging protrusions are in a pattern that provides skin-stretching effect.

* * * * *